US006499626B1

(12) United States Patent
Julius

(10) Patent No.: US 6,499,626 B1
(45) Date of Patent: Dec. 31, 2002

(54) DISPENSER FOR ARTICLES

(75) Inventor: Robert P. Julius, Greenwich, CT (US)

(73) Assignee: Nice-Pak Products, Inc., Orangeburg, NY (US)

( * ) Notice: Subject to any disclaimer, the term of this patent is extended or adjusted under 35 U.S.C. 154(b) by 98 days.

(21) Appl. No.: 09/718,944

(22) Filed: Nov. 22, 2000

(51) Int. Cl.[7] ..... B65H 1/00
(52) U.S. Cl. ..... 221/63; 221/303
(58) Field of Search ..... 221/33, 48, 63, 221/50, 303, 307; 206/449, 812, 813, 494, 205

(56) References Cited

U.S. PATENT DOCUMENTS

| | | | | |
|---|---|---|---|---|
| 2,640,587 A | | 6/1953 | Smith | |
| 4,289,262 A | | 9/1981 | Finkelstein | 225/106 |
| 4,328,907 A | | 5/1982 | Beard | 221/63 |
| 4,526,291 A | | 7/1985 | Margulies | 221/63 |
| 4,623,074 A | | 11/1986 | Dearwester | 221/48 |
| 4,848,575 A | | 7/1989 | Nakamura et al. | 206/449 |
| 5,002,200 A | | 3/1991 | Hunt | 221/1 |
| 5,516,001 A | | 5/1996 | Muckenfuhs et al. | 221/63 |
| 5,622,281 A | | 4/1997 | Annand | 221/48 |
| 6,299,017 B1 | * | 10/2001 | Hill | 221/63 |

* cited by examiner

*Primary Examiner*—Kenneth W. Noland
(74) *Attorney, Agent, or Firm*—Lerner, David, Littenberg, Krumholz & Mentlik, LLP

(57) ABSTRACT

A dispenser for dispensing individual interleaved and/or releasably attached articles such as sheets impregnated with moisture or a composition or substance useful for treating, cleaning and/or disinfecting various surfaces, including the human skin. The dispenser includes a dispensing element including at least one larger aperture and a smaller aperture entirely separated from one another. A closure or lid can usefully be incorporated. The articles may easily be reached from above the top surface of the dispenser through the larger aperture, and fed through from underneath the top surface to the small aperture. Thereafter, the articles may be dispensed through the small aperture, e.g., in a pop-up mode. The arrangement of the elements is conducive to one-handed dispensing of articles from the dispenser.

24 Claims, 6 Drawing Sheets

DISPENSER FOR ARTICLES

FIELD OF THE INVENTION

This invention relates to a dispenser for articles. More particularly, the present invention relates to sequential dispensers, in which the articles are provided as individual interleaved or separably connected sheets and can pop-up above the top of the dispenser when the preceding article is removed.

BACKGROUND OF THE INVENTION

Dispensers for articles such as tissues are well known in the art. Such articles may be supplied dry, with lotion, or moistened and are typically generally rectangular in shape and supplied as e.g., interleaved, discrete sheets or separably connected. Dispensers for such articles typically are in box form, e.g., in the shape of a parallelepiped. The dispenser has an opening, typically at the top, through which individual articles or sheets are removed by the user. The desire for increased convenience led to sequential or "pop-up" dispensers. In a pop-up dispenser, a tissue usually extends through an opening to an elevation above that of the dispenser. The user grasps the exposed portion of the tissue, without the necessity of inserting fingers through the opening. In pop-up dispensing, each tissue has a leading portion that is first to pass through the opening, and a trailing portion that later passes through the opening. In an interleaved arrangement, the trailing portion of a first tissue to be dispensed overlaps the leading portion of the next tissue to be dispensed. As the first tissue is withdrawn by the user, the leading portion of the next tissue is pulled through the opening, for later dispensing. The tissues are folded against one another in a variety of configurations so that the friction of the trailing portion of the withdrawn sheet against the succeeding sheet pulls the leading portion of the succeeding sheet through the opening. However, devices for interfolding are both complex and expensive. Purchasing such devices represents a significant capital outlay that is ultimately passed on to the consumer of the interfolded tissues.

One problem frequently encountered in pop-up dispensing packages of the prior art is the transition from the reach-in dispensing mode in which the product is shipped to the pop-up dispensing mode preferred by the consumer, as well as recovery from the dispenser of tissues that have fallen back in order to reinitiate the pop-up sequence. The opening through which the tissue is dispensed must be large enough to allow the consumer to reach his or her fingers therethrough to grasp the tissue and begin the pop-up dispensing process. However, the opening must be small enough to constrict the tissues dispensed therethrough, so that a tissue may be separated from succeeding tissues. Fallback is exacerbated with relatively tall dispensing packages that are often preferred by the consumer for economic reasons. The usable height of the dispensing package is often limited to the length of the overlap of the interfolded tissues. This limitation occurs due to the leading and trailing portions of adjacent tissues unfolding inside a package taller than the overlap, resulting in the second tissue falling back into the package. Furthermore, fallback can occur as a consequence of the tissue or article being impregnated with another substance, such as moisture, lotion, cleansing composition, etc. When the article is impregnated it is heavier and its surface friction may be reduced, therefore making it more susceptible to falling back. Various attempts to solve the problem of fallback when trying to dispense interfolded tissues are referred to in U.S. Pat. No. 5,516,001, but such solutions are said to have resulted in additional expense due to the use of additional elements or materials.

Similar problems of fallback occur even if tissues are not interfolded, but rather are connected at perforations. As fewer tissues remain in the bottom of a tissue package, particularly a taller package, a greater portion of the tissue hangs from the opening where they are dispensed to the top of the remaining articles at the bottom of the package. When this occurs, the weight of the free portion of the tissue increases, making it more likely that the frictional engagement with the opening is insufficient to prevent the tissue from falling back into the dispensing package. When fallback occurs, the user not only must reach through the aperture in the opening to retrieve the tissue and start the pop-up dispensing process all over again, but the tissue is well below the open, having fallen to nearly the bottom of a tall dispensing package.

Nakamura et al., U.S. Pat. No. 4,848,575 discloses variously configured apertures or a combination of large and small apertures joined by a slit-like portion. In each instance the user inserts fingertips into the openings to grasp a tissue and pull it through the opening, and, where a slit is present, deflecting the slit-like portion. However the shape of the various apertures is round, thereby reducing the chance of success in preventing fallback. Furthermore, in various embodiments the user is required to deflect the material at the opening in order to reach into the container to grasp a tissue and again to deflect it when pulling the tissue out. Where the dispenser is constructed of a rigid, albeit flexible, material, this process can be uncomfortable.

Beard, U.S. Pat. No. 4,328,907 uses a relatively small, opening of fixed, preferably rounded, shape, but also acknowledges that re-starting a sheet inadvertently broken off below the dispensing surface requires the user to open the dispenser.

Smith, U.S. Pat. No. 2,640,587 discloses a tissue dispenser in which the cover includes an hourglass-shaped opening that is sufficiently wide to permit insertion of fingers to grip tissues and withdraw them through the opening. Thus, at each side of the neck portion 14, the openings flare out to enlarged portions 16 and 18 for such purposes. The large opening makes such a dispenser susceptible to fallback.

Margulies, U.S. Pat. No. 4,526,291 discloses an opening that includes a closure that can be moved between a first position covering a smaller aperture in the dispensing surface or a second position that fully exposes the dispensing surface. The dispensing surface includes a larger aperture, 18, connected by a slit, 20, to a smaller aperture, 22. The larger aperture is said to permit a consumer to grasp a first towel of a web of towels and to pull the first towel toward and into the slit and smaller aperture. The side edges of the slit are said to apply sufficient tension on the towel being pulled through the slit to cause separation of the towel from a succeeding towel at the perforations whereby the succeeding towel is partially extended through the slit.

Dearwester, U.S. Pat. No. 4,823,074, discloses a dual dispensing carton, which includes an upper slot and an extending side slot, so that a bundle of tissues can be removed in a single instance.

Hunt, U.S. Pat. No. 5,002,200, discloses a container for plastic bags which, as shown in FIG. 1 thereof, includes an upper opening 17 through which the bags are passed, and a finger slot 18 in the front wall 11 to provide access to maneuver the bags for removal from the confined storage space. However, the invention relies on both the limited elastic memory of the plastic from which the bags are made and compressing or wadding into a bulbous shape of each individual bag by the consumer before placing each bag in the container for later removal from any opening in the container, including the finger slot. Pop-up operation of the container to dispense the plastic bags is not contemplated.

Muckenfuhs et al., U.S. Pat. No. 5,516,001, discusses the background of pop-up dispensers, the need to prevent the next tissue from falling back into the box and having both large and small apertures spaced apart, but connected to one another. As can be seen in FIG. 1 of the patent, the claimed dispensing opening has a first, larger sized aperture, 20 designed for "reach-in" and a second, smaller aperture 22 designed to constrict the tissues as they are pulled through the smaller opening, 22 by the user. This is said to mean that the tissues touch the walls of the opening upon withdrawal. The two apertures 20 and 22 are required to be connected by an "isthmic" connection 24 (essentially a slit). The disclosure contemplates wet tissues, in which case the package is said to be water impervious. Referring to FIGS. 3–5, a tissue grasped through the large aperture 20, is funneled through the taper 26, towards the apex 28, through the isthmus 24 towards 30 or 36 and, e.g., into one of the smaller openings 222. Thus, the lobes 34 and the narrower second aperture are intended to prevent the tissues from falling back into the package; the larger aperture 20 is intended to allow the user to grasp the tissue closest to the opening. This is also said to permit one to grasp the tissue if it has fallen back through the opening and to rethread it through the small aperture. However, as noted, the patent requires not only a connection between the larger and smaller apertures, but also a specific isthmus or slit-like shape for the connection. The introduction of the slit-like connection also requires that the lobes 34 adjoining the isthmus have a low modulus or high flexibility in order to allow for the passage of the tissue through the isthmus. Consequently, the low modulus or high flexibility reduces the ability of the lobes to hold, retain and/or separate an article, particularly a moisture impregnated article, and to prevent it from falling back into the dispenser. Furthermore, the structural arrangement of the isthmus and openings suggests that it would not be simple or inexpensive to fabricate the necessary equipment, such as a mold, to form the dispensing opening.

Annand, U.S. Pat. No. 5,622,281, discloses a dispenser which includes a control plate 20 that sits on top of the stack of sheets to be dispensed, and provides for removal through the side wall of the container.

There is a continuing need in the art for a dispensing element and a dispenser employing such an element that is functional, simple and inexpensive to fabricate and that provides the convenience of pop-up dispensing. There is a also a need in the art for a dispenser to allow for pop-up dispensing of articles such as impregnated tissues or cloths, particularly when supplied in relatively tall dispensers, but that prevents the articles from falling back through the dispensing element or, in the event such fallback occurs, conveniently to retrieve the article.

SUMMARY OF THE INVENTION

A dispenser for dispensing individual articles from a plurality of said articles, said dispenser comprising a housing including depending side walls for retaining said plurality of said articles and a top wall including a substantially planar outer surface having a first aperture including at least a pair of juxtaposed adjacent side walls sufficiently close to one another to grasp and retain said individual articles at least partially removed from said housing, and at least one second aperture entirely separate from said first aperture, said at least one second aperture being sufficiently large to permit said articles to be grasped by one or more fingers the human hand from above said at least one second aperture in order to thrust said individual article up and at least partially through said first aperture, whereby said article extends above said top wall and is retained by said first aperture for removal from said dispenser, and optionally including a closable cover for sealably closing said first aperture and said at least one second aperture. Articles usefully employed with such a dispenser include natural and/or synthetic cloth or paper sheets, preferably impregnated with moisture, one or more cleaners or skin treatment compositions.

The invention further comprises a dispensing element as described above for use with a plurality of such articles that are interleaved or releasably attached.

The structure of the invention allows a user to reach into a dispenser through the at least one larger opening to grasp one of the articles and pass it up and at least partially through the smaller aperture.

DETAILED DESCRIPTION

Figure 1:
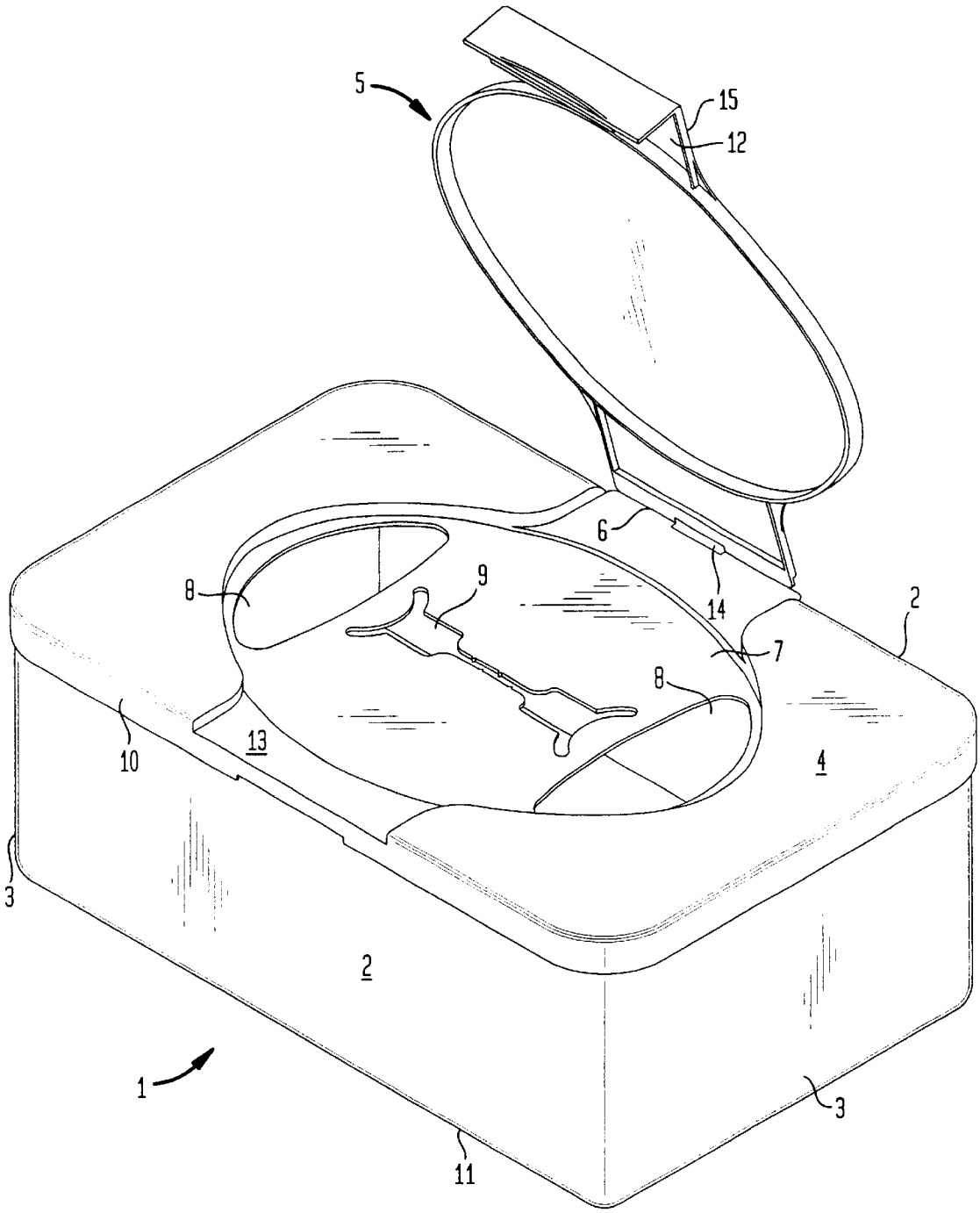
FIG. 1 is a perspective view of a dispenser according to the present invention.

The dispenser of the instant invention can be used with dry or impregnated articles, but is particularly useful for dispensing moisture-impregnated articles. For purposes of the present invention "moisture-impregnated articles" is defined to include articles impregnated with at least one substance selected from the group consisting of water, a surface cleaner, a cleaning composition capable of attracting particulate matter, a medicament, skin cleanser, skin moisturizer, skin lotion and antiseptic.

The "articles" usefully employed with a dispenser of the present invention include natural and/or synthetic cloth or paper sheets. Such articles include paper products such as tissues and woven and nonwoven products, the latter based on natural or synthetic fibers and mixtures thereof. The dispenser can contain articles such that the dispenser is either disposable or refillable. By "disposable" is meant a dispensing package containing a supply of articles intended to be discarded after the plurality of articles supplied therewith is depleted, i.e., the dispensing package is not intended to be restocked with such articles. Likewise, each article is discarded after use, and is not laundered, or otherwise restored. By "refillable" it is meant that the dispensing package is or may be restocked with articles after the supply is depleted.

Each article, i.e., an individual article, is releasably attached to each previous and subsequent article (except, respectively, for the first and last) by any releasable attachment means which allows easy separation to occur as the article is being dispensed or after the article is withdrawn through the dispensing element. The releasable attachment means may comprise adhesively joining the article to the adjacent articles with an adhesive that is suitable for use with the impregnant present on or in the article as well as with skin (where the impregnated article is intended to be used in contact with skin). "Releasably attached" means each article is easily separated from adjacent article, and may include releasable attachment means such as friction, cohesion, or other forces that releasably attach adjacent articles. Where articles are preferably interleaved, releasable attachment results from friction or cohesion between adjacent articles. In a preferred embodiment, each article is releasably attached to an adjacent article by a plurality of frangible lands. As used herein a "land" refers to a small connection separated by cuts and joining adjacent articles. Lands are considered to be "frangible" if, upon separation of one article from an adjacent article in tension, the lands break prior to significant ripping or tearing of either article. The articles may be connected by a plurality of lands. The number and size of the lands and cuts will vary depending on the type and composition of the article, e.g., whether an article is comprised of paper, cloth, non-woven synthetic fibers, etc. and whether it is dry or impregnated. Limited experimentation by one skilled in the art will readily determine the appropriate configuration to assure separation of the articles without undue tearing as well as assuring that the article is dispensed through the dispenser opening to assure availability of the succeeding article in the pop-up mode.

An article is considered to have been "dispensed through" the dispensing element when it passes at least partially from inside the dispenser to outside the dispenser, either due to the consumer reaching in, grasping the article and forcing it through the smaller dispenser opening from underneath the dispensing element, or the article popping up through the dispensing element, by trailing the article previously withdrawn by the user. An article is considered to be "withdrawn" after it has passed completely from inside the dispensing element to outside the dispensing element, and no portion or edge of the article remains within the dispensing element.

"Fallback" is described hereinabove. In summary, it is understood to mean that an article that has dispensed through the smaller aperture of the dispensing element, rather than being retained in the pop-up mode above the surface of the dispensing element and available to be grasped and withdrawn by the user, falls back into the dispenser and beneath the surface. The user is then required to reach into the dispenser to grasp the article in order to "re-thread" it through the smaller aperture of the dispensing element (as noted above, such a process may require the user to at least partially disassemble the dispenser in order to gain access to the article). Fallback can occur as a consequence of the weight, thickness and/or frictional characteristics of the article in combination with the structure of the smaller aperture of the dispensing element and the surface characteristics of the material from which the walls of that opening are made, e.g., their frictional properties. Even an article that is dry can be subject to fallback if the aperture is improperly sized or shaped to grab and hold the article, particularly when the article is heavy, and given the size, shape and frictional properties of the aperture.

Referring to FIG. 1, the dispenser 1 according to the present invention comprises front, back and side walls 2 and 3, a top wall 4, also referred to as dispensing element 4, which includes the smaller aperture 9 through which an article is dispensed (i.e., a dispensing opening). The dispenser 1 is generally box shaped in the form of a parallelepiped, although it will be appreciated by one skilled in the art that the dispenser can be cylindrical with appropriate adjustment to the shape of the dispensing element 4. Furthermore, the dispenser can be made to include a bottom wall 11, or the bottom can be left open to facilitate refilling of a refillable dispenser.

The dispensing element 4 is generally planar with at least one dispensing aperture 9 therein. Alternatively, the dispensing element 4 can be convex i.e., dome-shaped, or concave. In each instance the dispensing element can be made to be removable from the walls of the dispenser as indicated by the overlapping or fitted connection therewith at 10. Where the dispenser is constructed to include a bottom wall 11, the dispensing element 4 is removable where the dispenser is intended to be refillable. A plurality of articles are disposed in the dispenser.

The dispenser 1 and/or dispensing element 4 can be constructed so as to be closable using a hinged lid or closure such as 5. A closure is particularly useful where the articles are impregnated with a substance that is susceptible to evaporation if the dispenser is left open, especially when at least one article is exposed in the pop-up position. It is also preferred where it is particularly necessary to avoid contamination of the impregnated articles, such as in a medical application or contact with sensitive skin is anticipated. The closure can be formed so as to cover only the area encompassed by the apertures or it can be formed so as to close the entire top of the dispensing element 4, or a major portion thereof. Where less than the entire top of the dispensing element is closable, it is convenient, but not required, to recess the closure 5 within a recess 7. In that circumstance as well as generally, it is useful to include a closure release 12 to facilitate opening and closing the closure. Where the closure overlaps the dispensing element at 13, it is convenient to have the area recessed as it is for 7 so that the closure 12 is recessed within the area 13 and the top surface of the closure 15 is contiguous with the top surface of 4. Where the closure joins the dispensing element at 6, it is particularly useful to form the joint so as to construct a "living hinge", e.g., using a polyolefin such as polypropylene, and further to include an opening therein, as shown at 14, in order to reduce the stress on the hinge 6. Alternatively, a conventional hinge well known to those skilled in the art can be constructed using multiple elements and incorporating a lid or closure 5 as a separate element and dispensing element 4. Preferably, such a conventional hinge can be constructed from such elements fabricated from polymeric materials in suitable shapes that can snap together in the area shown at 6 in FIG. 1 in order to form the hinge.

Incorporation of a closure or lid in combination with the separate, larger second aperture 8 in the dispensing element or the dispenser is particularly useful for protecting an article, particularly a moisture-impregnated article, that has been dispensed through the first aperture 9, resulting in a large portion of the article extending above the top surface of 4 while the article remains in the pop-up mode. In such circumstances, the user can return the lead end of the extended portion of the article into the larger aperture 8 from above the top surface 4 so that it is partially secured and close the lid in order to prevent the article from drying out or becoming contaminated. Similarly, an article that has been inadvertently withdrawn from the dispenser can be placed in the larger aperture 8 and the lid closed in order to prevent the article from drying out or becoming contaminated. Upon reopening the lid, either the inadvertently withdrawn article or the leading end of the dispensed through article is easily retrieved from the larger aperture without having experienced fallback and/or the need to rethread the article through the smaller aperture in order to initiate the pop-up mode.

Examining the general configuration of the first aperture 9, it may have any suitable shape, and is smaller in area than the larger second aperture 8. It is critical that the first aperture 9 be smaller in area than the second aperture 8, so that articles that are dispensed from the dispenser 1, after the first article has been withdrawn, do not fall back into the dispenser. The second aperture 8 serves to allow the user to grasp the article closest to the dispensing element 4.

The height of the dispenser can be an issue if it exceeds the overlap of interleaved articles (as described above), or if articles are joined by releasable attachment means and the breaking strength of the releasable attachment means is overcome by the weight of the article between the releasable attachment means and the magazine or plurality of articles therebelow. As the dispenser is made taller in the vertical direction, and the weight of the free hanging article increases, the aperture 9 of the dispensing element 4 is preferably more restrictive in order to grasp and hold the article so as to prevent the article to be dispensed from falling back into the dispenser. Furthermore, as the articles become thicker, the configuration of the aperture 9 can be adjusted in order to permit the articles to be dispensed according to the present invention. The first aperture is of a size designed to constrict the articles as they are pulled through aperture 9 by the user. Articles are considered to be "constricted" when they must touch one or more walls of aperture 9 upon withdrawal by the user.

There is present in the dispensing element at least one second aperture 8 that is entirely separate from the first aperture 9. For purposes of the present invention, "entirely separate" means that apertures 8 and 9 do not share a common perimeter, including that they are not joined by a slit of any width. The second aperture is of a size suitable so that a user can reach into the dispenser to grasp an article and push it through the aperture 9 from beneath the surface of the dispensing element in order to initiate the pop-up mode of dispensing an article from a plurality of articles present in the dispenser when the dispenser is first supplied or re-supplied with articles, or to re-initiate the pop-up mode if an article has fallen back into the dispenser.

It is to be understood that the articles may either be wetted, impregnated or dry. One skilled in the art will recognize that the dispenser 1 will be impervious to water, moisture or another substance if the articles are wetted or impregnated with such substance. For example, the dispenser and/or dispensing element can be formed of a semi-rigid thermoplastic material selected from the group consisting of polyolefins and polyamides; preferably the dispenser and dispensing element are formed of the same material. The dispenser and dispensing element are particularly useful with articles that are impregnated with at least one substance selected from the group consisting of water, surface cleaner, cleaning composition capable of attracting particulate matter, a medicament, skin cleanser, skin moisturizer, skin lotion and antiseptic.

Figure 2:
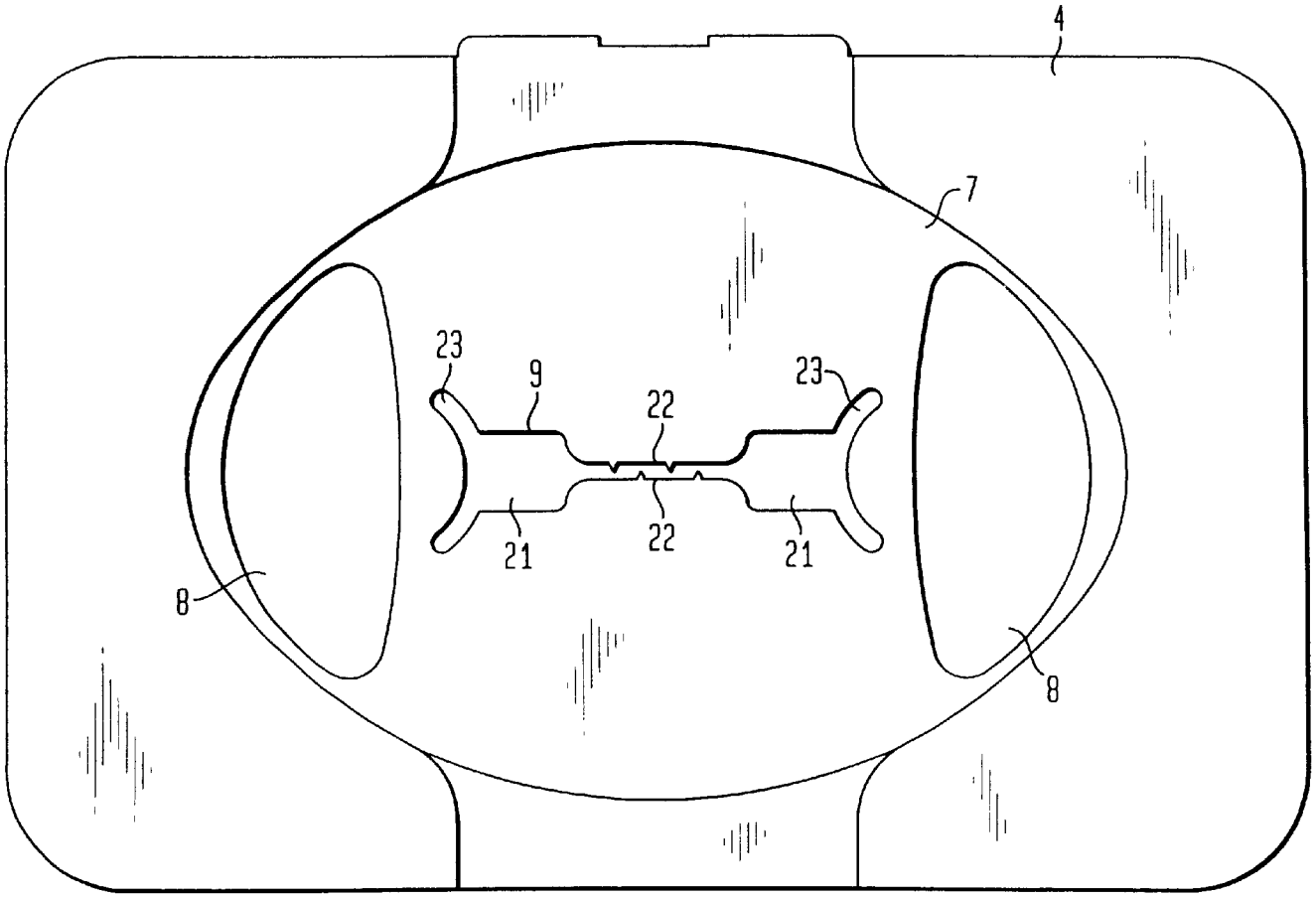
FIG. 2 is a plan view of a preferred embodiment of the dispensing element according to the present invention.
Figure 3:
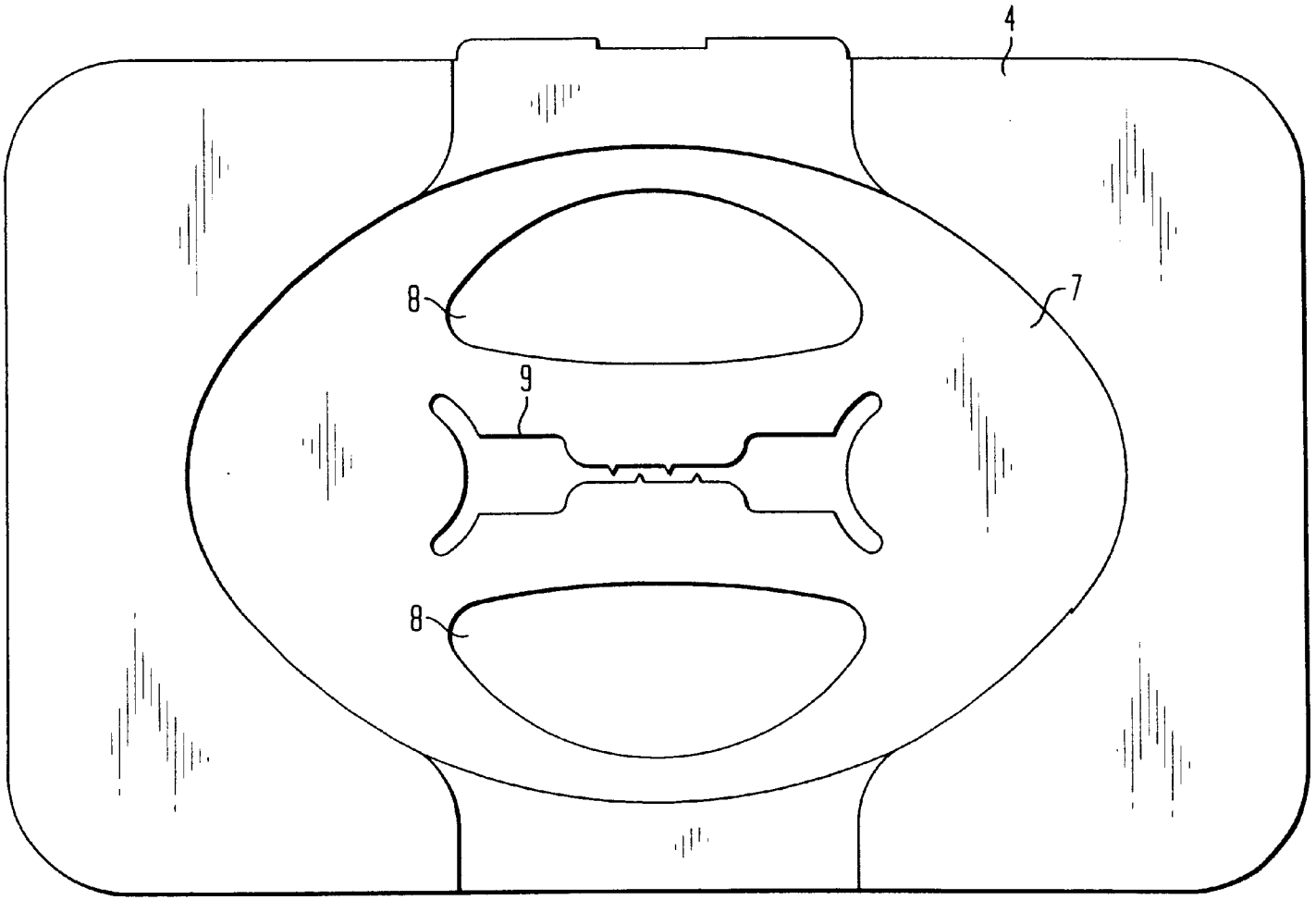
FIG. 3 is a plan view of an alternative embodiment of the dispensing element according to the present invention.

Referring to FIG. 2, the dispensing element 4 comprises first and second apertures 8 and 9, entirely separate and spaced apart from one another. The recessed area 7 within which apertures 8 and 9 are located, is generally oval or elliptically shaped, although such area also can be any other convenient shape, such as generally rectangular. The second aperture 8 is larger in area than the first aperture 9. A suitable second aperture 8 may be generally half-moon shaped with the outer perimeter adjacent the recessed area 7 and generally following the shape of recessed area 7, or generally rectangularly shaped with, e.g., two or more rounded corners where, e.g., area 7 is rectangularly shaped. Aperture 8 conveniently has dimensions of about 6 centimeters by about 2.5 centimeters. However, the dimensions and specific shape of aperture 8 can be varied, e.g., for aesthetic reasons, provided that the dimensions and shape are sufficient to permit the fingers of a user to reach within the dispenser, grasp an article and initiate or re-initiate the pop-up function as described above. The second aperture 8 may be juxtaposed with (a) the short edge of the dispensing element 4 as shown; (b) the long edge of the dispensing element; (c) a corner thereof; or (d) disposed in any other suitable position as desired. An alternative arrangement for apertures 8 and 9 is illustrated in FIG. 3. Furthermore, by enlarging area 7 in the general direction along the long dimension of first aperture 9, one or more additional apertures 8 can be included at the positions as shown in FIG. 1 in order to provide for several, spaced apart larger apertures, each entirely separate from aperture 9.

Figure 4:
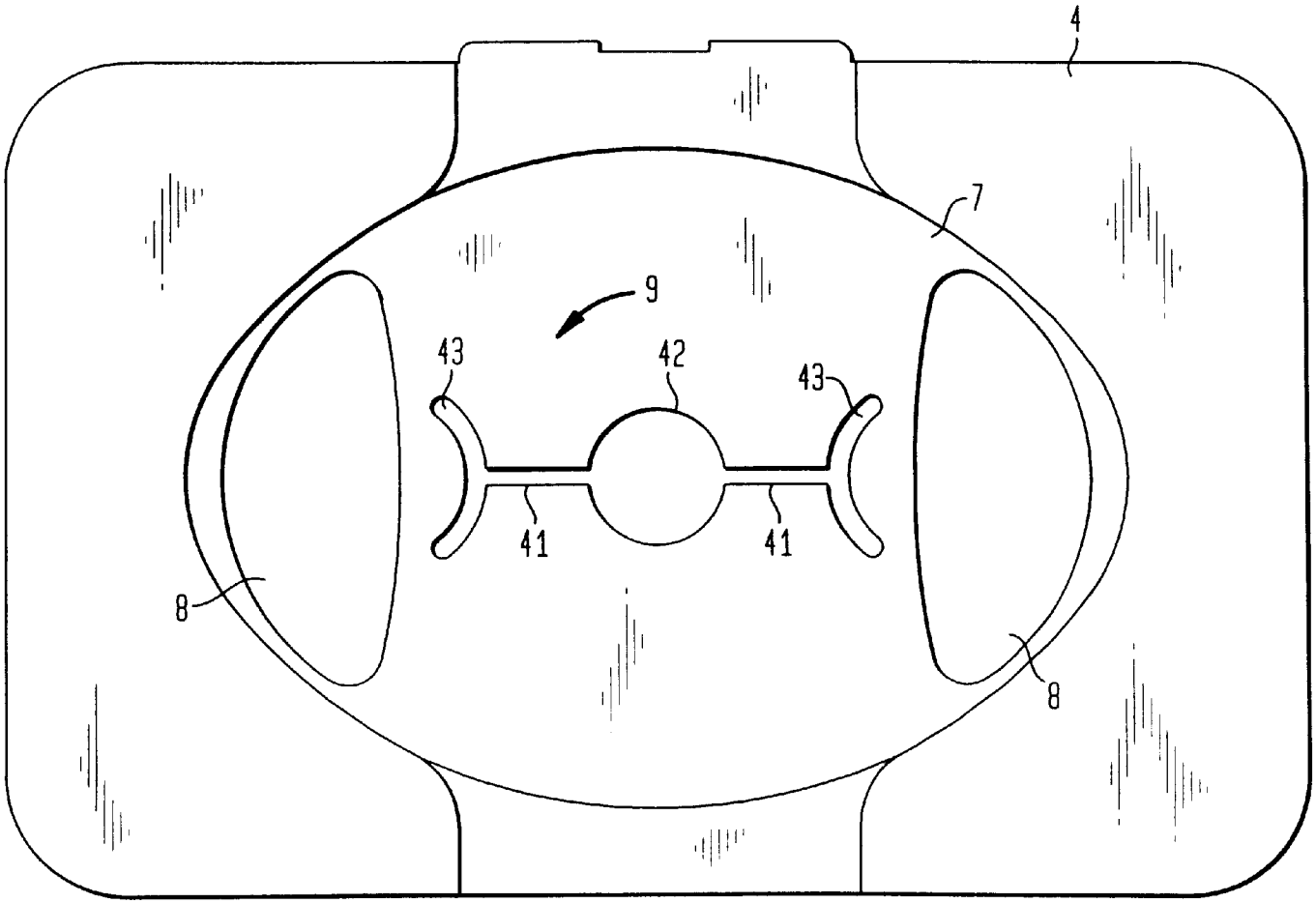
FIG. 4 is a plan view of an alternative embodiment of the smaller aperture in the dispensing element according to the present invention.
Figure 5A:
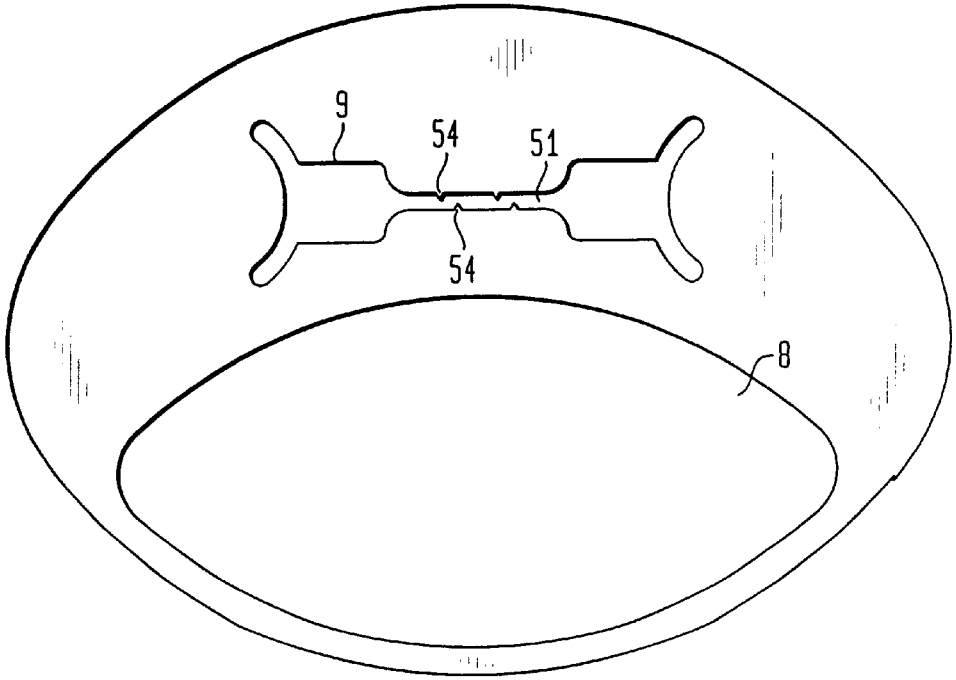
FIGS. 5(*a*) and 5(*b*) are plan views of an alternative preferred embodiments of the dispensing element according to the present invention.
Figure 5B:
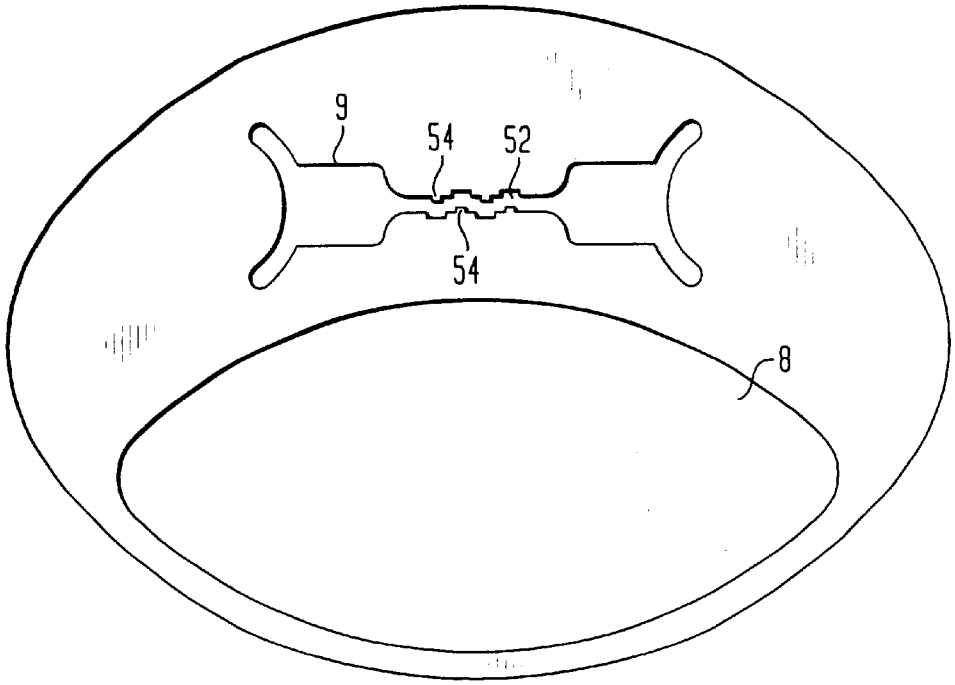

Referring again to FIG. 2, the first aperture 9 includes a pair of juxtaposed adjacent sidewalls 22, sufficiently close to one another to grasp and retain individual articles that are at least partially removed or dispensed from the dispenser, i.e., in a pop-up position. The opening at 22 can be sufficiently narrow so as to form a slit joining larger areas 21. A "slit" refers to a severing between two otherwise contiguous pieces of material, wherein the opposite sides of the slit are touching, the slit having not been formed by removal of the material. Alternatively, and preferably, the opening may comprise a narrow passageway wherein opposite sides are in close proximity but do not touch. It will be appreciated by one skilled in the art that the specific shape of aperture 9, including closely juxtaposed sidewalls 22, areas 21 and narrow protuberances or extensions 23 are not significant, provided that aperture 9 is capable of grasping and retaining an article in a dispensed or pop-up position. For example, the narrow protuberances 23 also can be viewed as alternative or assisting means by which an article is held in a pop-up position as a consequence of being "trapped" by a narrow passageway communicating from beneath the dispensing element to above the dispensing element; this can also occur with the use of a slit. In the present illustrations, the protuberances are shown with rounded sidewall configurations, but they can, of course have sharp, angular shapes which are included within the scope of the invention. An alternative embodiment for aperture 9 is illustrated in FIG. 4, including narrow passageways 41, small opening 42 and protuberances 43; others shapes can be found illustrated in the prior art, e.g., U.S. Pat. Nos. 4,328,907, 4,289,262 and 4,848,575, relevant parts thereof, including the figures, incorporated herein to the extent permitted. Alternative preferred embodiments for apertures 8 and 9 are shown in FIGS. 5(*a*) and 5(*b*). In these embodiments the narrow passageways 51 and 52 include ridges or teeth, 54, designed to engage the article and hold it in the pop up position so as to prevent or reduce the chance of it falling back into the dispenser as well as to grasp the article so as to facilitate separation of one article from the following article. Furthermore, the embodiments illustrated in these figures include a single larger aperture, 8 that is positioned in a direction parallel to and beneath the long dimension of the smaller aperture 9. The single larger aperture is also shown to be relatively larger than those illustrated in FIGS. 1–4, in which two larger apertures are included. The use of such a single larger aperture facilitates reaching into the dispenser as well as feeding of an article through the underside of the smaller aperture 9. In each instance, it is the objective that the size and shape characteristics of the smaller aperture are sufficient to grasp and hold the article in a more restrictive portion or passageway thereof, so as to prevent or significantly inhibit the article from falling back into the dispenser 1 as well as to provide that the articles can be withdrawn from the dispenser as separate articles. In other words, interleaved articles or adhered articles will be separated from one another by overcoming frictional or adhesive forces and releasably attached articles joined e.g., by frangible lands, will have the lands broken so as to allow individual articles to be withdrawn.

Figure 6:
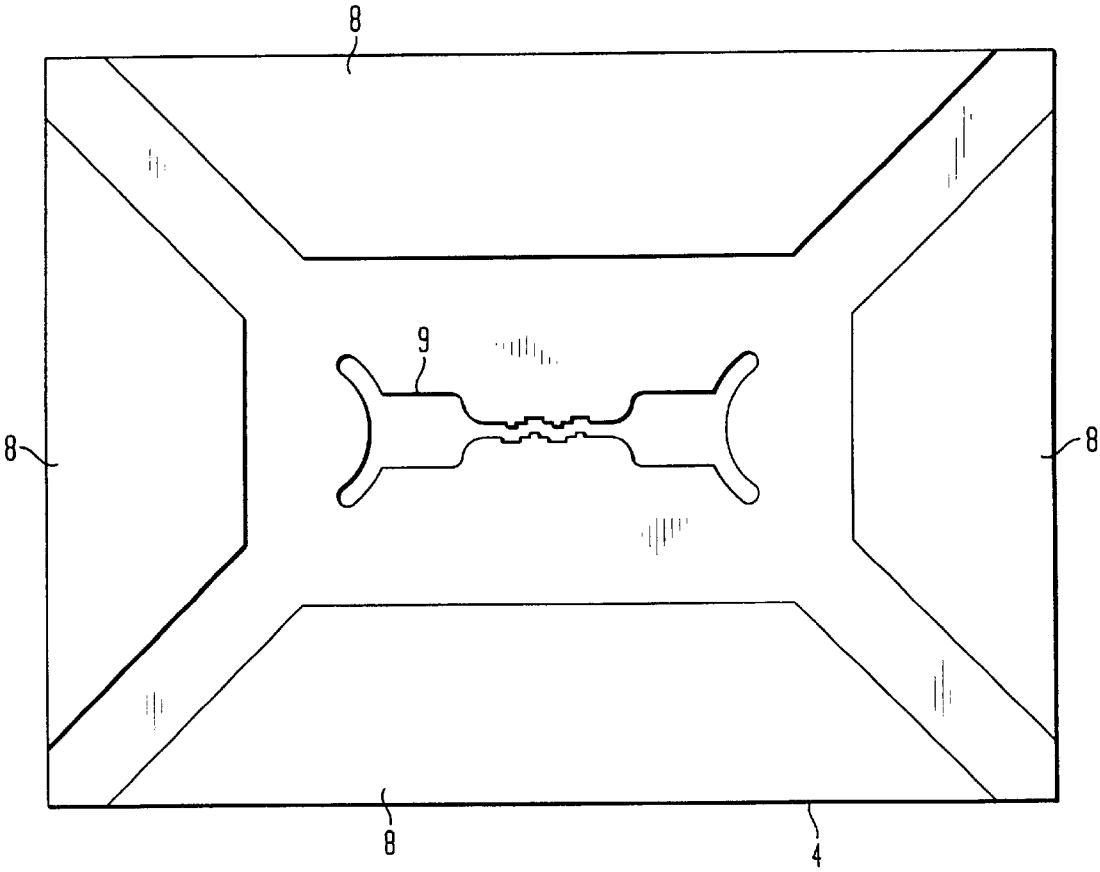
FIG. 6 is a plan view of an alternative preferred embodiment of the dispensing element incorporating several larger apertures according to the present invention.

Referring to FIG. 6, an alternative embodiment of the dispensing element 4 according to the present invention includes four larger apertures, 8, each comprising a substantial portion of the area of each quadrant of the surface. A similar result would obtain where the dispensing element is circular or oval instead of rectangular, square, pentagonal, hexagonal, (or any polygonal shape), etc. In each instance, several large apertures can be located or distributed around the perimeter of the surface as exemplified in FIG. 6, provided that the remaining surface area of the dispensing element 4 has sufficient strength to function as described in combination with the article to be dispensed. The smaller aperture 9 can be configured to include the features of, for example, FIG. 5(*a*) or 5(*b*) or another shape, provided that it satisfies the requirement described immediately above, in that the size and shape characteristics of the smaller aperture are sufficient to grasp and hold the article when it is dispensed through the dispensing element.

In operation, articles may be dispensed from the dispenser 1 according to the following procedure. The user inserts his or her fingers through the second aperture 8, and partially dispenses at least a first article by grasping it, e.g., with the thumb and forefinger and, from beneath the surface of the dispensing element 4, pushing the article up and at least partially through smaller opening 9. The first article is withdrawn from the dispenser 1 through the smaller first aperture 9. The first article is then separated from the adjacent or succeeding article. The first article may be separated by breaking frangible lands between successive articles, overcoming frictional or adhesive forces (if the articles are adhesively joined), or exceeding the tensile strength of any other releasable attachment means that may be employed. The present invention is particularly suited to the withdrawal of individual articles from a dispenser using one hand, even in those circumstances where an article has fallen back into the dispenser (as described above). This can be particularly important where the articles being dispensed are intended for the care of an infant, requiring the user to maintain the security of the infant with one hand while withdrawing an article, especially an article impregnated with a composition used to clean or treat the skin of the infant.

Although the invention herein has been described with reference to particular embodiments or variations within the scope of the claims, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A dispenser for dispensing individual articles from a plurality of said articles, said dispenser comprising a housing including depending side walls for retaining said plurality of said articles and a top wall including a substantially planar outer surface having a first aperture including at least a pair of juxtaposed adjacent side walls sufficiently close to one another to grasp and retain said individual articles at least partially removed from said housing, and at least two second apertures entirely separate from said first aperture, said at least two second apertures being sufficiently large to permit said articles to be grasped by one or more fingers of the human hand from above one of said at least two second apertures in order to thrust said individual article up and at least partially through said first aperture, whereby said article extends above said top wall and is retained by said first aperture for removal from said dispenser.

2. The dispenser of claim 1 wherein said substantially planar outer surface includes a recessed portion, said first aperture and said at least two second apertures being disposed in said recessed portion.

3. The dispenser of claim 2 including a closable cover sized so as to closably seal said recessed portion upon closure thereof.

4. The dispenser of claim 3 including a living hinge connecting said closable cover to said housing.

5. The dispenser of claim 1 wherein said top wall is separate from and affixable to said depending sidewalls of said housing.

6. The dispenser of claim 5 wherein said closable cover is affixed to said top wall.

7. The dispenser of claim 1 wherein said housing has sufficient rigidity to retain its shape subsequent to its manufacture.

8. The dispenser of claim 7 wherein said housing comprises semi-rigid thermoplastic material.

9. The dispenser of claim 8 wherein said thermoplastic material is selected from the group consisting of polyolefins and polyamides.

10. The dispenser of claim 1 wherein said housing includes a bottom wall.

11. The dispenser of claim 10 wherein at least one of said top wall and said bottom wall is removable from said housing for filling said housing with said plurality of articles.

12. The dispenser of claim 1 further including a closable cover for sealably closing said first aperture and said at least two second apertures.

13. The dispenser of claim 12 wherein said at least two second apertures comprises at least four of said second apertures disposed around the perimeter of said substantially planar surface.

14. The dispenser of claim 1 wherein said articles comprise moisture impregnated articles.

15. The dispenser of claim 14 wherein said moisture impregnated articles are impregnated with at least one substance selected from the group consisting of water, surface cleaner, cleaning composition capable of attracting particulate matter, a medicament, skin cleanser, skin moisturizer, skin lotion and antiseptic.

16. The dispenser of claim 1 wherein said articles are interleaved and/or releasably attached.

17. The dispenser of claim 1 wherein said juxtaposed adjacent side walls of said first aperture are so constructed as to cause said individual article to be separated from said plurality of articles upon said individual article being withdrawn from said dispenser.

18. A dispenser for dispensing individual articles from a plurality of said articles, said dispenser comprising a housing including depending side walls for retaining said plurality of said articles and a top wall having curvature extending upwardly or downwardly from said dispenser and having a first aperture including at least a pair of juxtaposed adjacent side walls sufficiently close to one another to grasp and retain said individual articles at least partially removed from said housing, and at least one second aperture entirely separate from said first aperture, said at least one second aperture being sufficiently large to permit said articles to be grasped by one or more fingers of the human hand from above said at least one second aperture in order to thrust said individual article up and at least partially through said first aperture, whereby said article extends above said top wall and is retained by said first aperture for removal from said dispenser.

19. The dispenser of claim 18 wherein said top wall has a curvature extending upwardly from said dispenser.

20. The dispenser of claim 18 wherein said top wall has a curvature extending downwardly from said dispenser.

21. A dispensing element for dispensing individual articles from a plurality of said articles, said dispensing element comprising a substantially planar surface having a first aperture including at least a pair of juxtaposed adjacent side walls sufficiently close to one another to grasp and retain said individual articles at least partially above said opening, and at least two second apertures entirely separate from said first aperture, said at least two second apertures being sufficiently large to permit said articles to be grasped by one or more fingers of the human hand from above one of said at least two second apertures in order to thrust at least one of said individual articles up and at least partially through said first aperture from beneath said first aperture, whereby said article extends above said surface.

22. The dispensing element of claim 21 adapted for use with a dispenser capable of holding a plurality of interleaved and/or releasably attached articles.

23. The dispensing element of claim 22 further including a closable cover for sealably closing said first aperture and said at least two second apertures.

24. The dispensing element of claim 23 wherein said at least two second apertures comprises at least four of said second apertures disposed around the perimeter of said substantially planar surface.

* * * * *